US005586415A

United States Patent [19]

Fisher et al.

[11] Patent Number: 5,586,415

[45] Date of Patent: Dec. 24, 1996

[54] FLASHING DEVICE FOR USE WITH EXTERIOR SIDING

[76] Inventors: Fred M. Fisher, 2450 Bass Bay Dr.; Jack R. Powis, 8085 Briarcreek St., both of Tallahassee, Fla. 32312

[21] Appl. No.: 253,916

[22] Filed: Jun. 3, 1994

[51] Int. Cl.[6] ..... E04D 1/36

[52] U.S. Cl. ..... 52/58; 52/61

[58] Field of Search ..... 52/58, 61, 204.53, 52/211, 105, D16; 156/257

[56] References Cited

U.S. PATENT DOCUMENTS

| | | | |
|---|---|---|---|
| 1,636,365 | 7/1927 | Hokanson . | |
| 3,719,548 | 3/1973 | Keck et al. | 156/257 X |
| 4,555,882 | 12/1985 | Moffitt et al. . | |
| 4,700,512 | 10/1987 | Laska | 52/58 |
| 4,966,819 | 10/1990 | Schatz et al. . | |
| 5,018,333 | 5/1991 | Bruhm . | |
| 5,027,572 | 7/1991 | Purcell et al. . | |
| 5,072,552 | 12/1991 | Sauder . | |
| 5,109,641 | 5/1992 | Halan | 52/58 X |

FOREIGN PATENT DOCUMENTS

| | | | |
|---|---|---|---|
| 2363016 | 7/1975 | Germany | 52/58 |

OTHER PUBLICATIONS

Dealer Focus, vol. 4, No. 2, p. 2 (Apr. 1994).

*Primary Examiner*—Wynn E. Wood
*Assistant Examiner*—Aimee E. McTigue
*Attorney, Agent, or Firm*—Sixbey, Friedman, Leedom & Ferguson

[57] ABSTRACT

A water flashing device is provided for use in conjunction with the installation of exterior building siding materials to create a moisture-impervious barrier that directs water to the exterior of the siding to prevent damage to building walls caused by water and moisture. The flashing device has a substantially rectangular planar structure and is preferably configured to be secured tightly adjacent to any corner of a window or door opening, most effectively at the bottom corners of a window opening in a building exterior wall to be covered by vinyl siding materials. The flashing device is formed of a flexible, waterproof material and has an engagement surface and a water-diverting surface. The engagement surface may be completely covered with a layer of pressure sensitive adhesive or may include selectively placed strips of pressure sensitive adhesive that is protected by a release paper until the flashing device is to be installed.

7 Claims, 2 Drawing Sheets

FLASHING DEVICE FOR USE WITH EXTERIOR SIDING

TECHNICAL FIELD

The present invention relates generally to flashing devices and specifically to a flashing device designed for use with exterior siding materials to form a moisture impervious, water-diverting barrier at joints between the siding and other building materials.

BACKGROUND OF THE INVENTION

There are several locations on the exterior of a building that are vulnerable to penetration by moisture unless the exterior surface is properly sealed to prevent the moisture from entering the building interior and damaging walls and other interior structures. The locations that are especially vulnerable to moisture penetration include those places where different materials are joined together, such as, for example, the joints between the building exterior walls and windows or doors. Exterior siding material, by itself, cannot be installed tightly enough at such joints to produce a moisture proof seal. Once the exterior siding material has been completely installed, these joints may be filled with a waterproof sealing material, such as caulk, to keep moisture away from the interior walls. However, available caulking materials have a limited effective life and eventually lose their sealant capability and must be replaced.

Some types of exterior building siding materials, for example, vinyl siding and aluminum siding that are made to simulate wood clapboard siding, have configurations that tend to cause water to collect behind the siding, particularly if it has not been installed or caulked carefully. Moisture can then easily penetrate into the building interior walls and other structures. Caulking the joints between the siding and the window or door trim is helpful in preventing water collection and moisture penetration. However, if the caulking is improperly applied or cracks as it ages, the water collection and moisture penetration problems return.

The prevention of water damage around window frames, door frames and similar structures has been addressed by the prior art. For example, U.S. Pat. No. 4,555,882 to Moffitt et al. discloses a moisture guard for inhibiting water damage to the interior of a home or building caused by moisture, leaks, rain or snow accumulating at door frames, window frames and the like. This device is made of metal and plastic and has a Z-shaped cross-sectional configuration so that it may be positioned under and adjacent to the sill of a window frame or door frame to cover the sill. This moisture guard design, however, does not extend far enough beyond the window frame to cooperate with the siding configuration to direct moisture that might collect behind the exterior siding away from the interior wall. Additionally, the design of this moisture guard is more complex than is necessary to achieve the desired results.

U.S. Pat. No. 1,636,365 to Hokanson discloses a metallic window flashing formed with ribs designed to fit into grooves in the window facing. This particular kind of window flashing is limited in use to the double sash or double hung window design described in the Hokanson patent. More contemporary window styles, as well as double hung windows made of materials other than wood, require a flashing with a different configuration from that shown by Hokanson.

U.S. Pat. Nos. 4,966,819 to Schatz et al. and 5,018,333 to Bruhm disclose flashings for skylights or roof windows. The Schatz et al. patent discloses the formation of a water-tight transition configured to fit under the roof tiles with a lead apron covered with a layer of aluminum to prevent cracks in the lead. The Bruhm patent discloses a skylight flashing formed of four flanged and lapping panels made of an elastomeric material to form a weathertight seal. Neither of these patents suggests a flashing device that could be used to provide a watertight seal around a vertical window or door opening which also functions cooperatively with the siding material to direct water to the exterior of the siding.

U.S. Pat. No. 5,072,552 to Sauder describes a corner flashing device which provides a watertight seal. However, this flashing device is specifically designed to include a base and an upstanding adjustable portion so that the flashing can be used to prevent moisture penetration at the corners of such roof structures as chimneys and dormers and is not designed to cooperate with an exterior siding material to divert water to the exterior of the siding.

The use of a metal flashing piece for preventing water from accumulating behind aluminum siding has been suggested in conjunction with the installation of aluminum siding. An early installation guide for the installation of aluminum siding directed the installer to cut, freehand, a piece of flashing from metal coil stock flashing material of a suitable size and shape and position it at a window corner under a siding receiving channel and over the top of the siding panel below the window. The method of flashing a window or door corner described in this installation guide would be an effective way to prevent water from getting behind aluminum siding if it was followed correctly. However, because the preparation of a proper flashing piece requires the installer not only to have available the required metal flashing stock material but also to cut this material to the correct size and configuration to fit securely about a right angle corner structure, the installation of such corner flashing pieces has largely been ignored by siding installers. Consequently, the difficulty and inconvenience of first individually hand-making and then properly installing corner flashing while siding installation was in progress has resulted in no flashing being installed, which, in turn, has caused water damage at window and door corners where the siding joint was not sealed by a flashing material.

The prior art has failed, therefore, to provide a readily available, simple, unitary flashing device configured and formed of a material which allows it to be easily installed adjacent to a window or door frame in conjunction with the installation of exterior siding both to provide an effective watertight seal and to direct water away from under the siding to the building exterior. A need exists for such a flashing device.

SUMMARY OF INVENTION

It is a primary object of the present invention, therefore, to overcome the disadvantages of the prior art and to provide a simple, unitary flashing device for use in conjunction with exterior siding materials which is easily installed to provide a watertight and water-diverting barrier.

It is another object of the present invention to provide a flashing device having a configuration which may be easily applied to create a moistureproof water-diverting barrier at the bottom corners of a window or door.

It is a further object of the present invention to provide a flashing device which can be securely attached to a building exterior wall surface under the exterior siding to cooperate with the siding configuration to divert water away from the building interior walls.

It is still another object of the present invention to provide a single unitary flashing device that may be universally installed in all door and window frame applications.

It is still a further object of the present invention to provide an inexpensive flashing device that is simply and easily installed to provide a moistureproof water-diverting barrier at any door or window corner with substantially no modification.

The aforesaid objects are satisfied by providing a flashing device configured to fit tightly adjacent to the corner of a window or door frame and securely to a building exterior wall in connection with the installation of an exterior siding material, preferably siding of the vinyl type that is designed to simulate wood clapboard siding. The flashing device has a substantially rectangular planar configuration with a right angle notch formed in one corner. The flashing device further includes an engagement surface which adhesively engages the building exterior and a water-diverting surface which cooperates with the siding material to direct water away from the building structure.

Other objects and advantages will be apparent from the following description, claims and drawings.

DESCRIPTION OF THE PREFERRED EMBODIMENTS

Exterior siding used in residential construction, especially siding made of aluminum, vinyl and similar materials configured to simulate wood clapboard siding, is typically formed in long strips or panels that are applied to the sides of the building in horizontal rows. This process usually begins at the lowermost edge of the exterior wall so that the siding is applied from the bottom to the top of the exterior wall over a sheathing material, housewrap or the like. The siding panels are configured so that the bottom of each strip overlaps the top of the strip below it. Each siding panel is also configured to include an upper edge with structures that engage corresponding structures on the bottom edge of the panel above. This secures the panels together and helps to direct water down the face of the siding so that moisture does not collect behind the siding panels. This arrangement effectively directs water away from the interior walls on an unbroken planar expanse of wall. However, the joints between the siding and window or door frames and other exterior structures have been difficult to seal effectively against the collection of moisture behind the siding. The bottom corners of windows where the siding meets the window trim have been particularly vulnerable to water seepage and the attendant damage it causes. Until the present invention, the primary solution to this problem was to apply caulking or another waterproof material to the siding—window frame joint to seal it. Unless a siding installer took the time to hand fashion some sort of flashing piece from available materials, it has not been customary to use flashing at window or door corners. However, the methods and devices currently used have not proven to be a satisfactory permanent solution to the water damage problem. The present invention provides an effective, substantially permanent solution to the problems presented by the collection of water at siding joints. The device of the present invention is described for use in forming a water-diverting seal at the bottom corner of a window frame in an exterior wall covered by vinyl siding. However, it is anticipated that the present device could be used to seal any kind of framed opening or similar structure in a building exterior wall in conjunction with the application of an exterior siding material.

Figure 1:
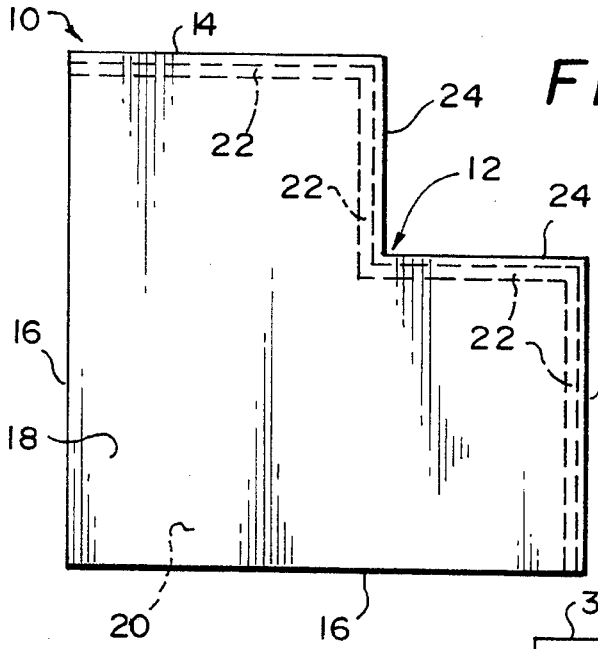
FIG. 1 illustrates a top plan view of one embodiment of a flashing device according to the present invention.
Figure 2:
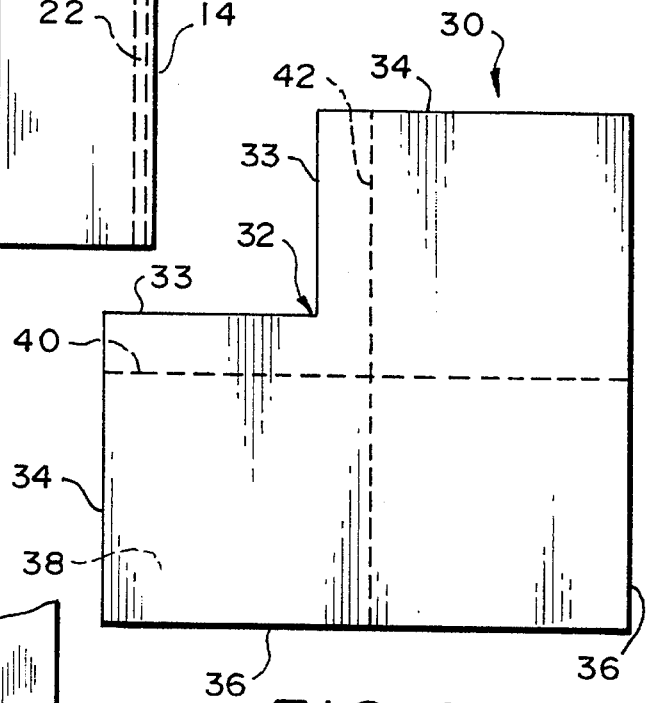
FIG. 2 illustrates a top plan view of another embodiment of a flashing device according to the present invention.

Referring to the drawings, FIG. 1 illustrates a top plan view of the flashing device 10 of the present invention. This flashing device has a planar configuration that is preferably substantially rectangular in shape with a right angle notch 12 cut from one corner so that sides 14 of the flashing device adjacent to the notch are shorter than sides 16. The flashing device 10 is shown with the notch 12 positioned as would be required to fit against the bottom left corner of a window or door. However, the flashing device 10 can be turned 90° so that the notch 12 will fit around the bottom right corner of a window or door, as is shown in FIG. 2.

The flashing device 10 must be made of a flexible material that can be easily handled during installation, yet is sufficiently rigid to perform its intended water-diverting function. In addition, the flashing material must be easily cut with conventional cutting tools that are readily available to the siding installer and will not damage the siding material when the device is trimmed to fit a particular type of siding. Preferred materials for forming the flashing device 10 include plastic, foil, foam, vinyl and coated paper. Laminar materials, such as for example, a layer of plastic and a layer of paper could also be used. Other flexible waterproof materials may also be used for this purpose. A preferred thickness for the flashing device 10 is about 1/16 inch. Other appropriate thicknesses could also be used, however.

One especially preferred material for forming the flashing device of the present invention that is both sufficiently flexible and waterproof and is also inexpensive is a closed cell polypropylene foam sheet material such as the sheet material known as MICROFOAM® manufactured by Ametek, Inc. of Chadds Ford, Pa. MICROFOAM® has the following physical characteristics:

| Property | Value |
|---|---|
| Density | 0.6 lb/ft$^3$ |
| Tensile Strength | MD 25 psi |
| | TD 25 psi |
| Elongation | MD 45% |
| | TD 40% |
| Transmission Rates | (1/16" single ply) |
| Water Vapor | 6.1 gm/100 in$^2$/24 hr |
| Oxygen | 1475 cc/100 in$^2$/24 hr/atm |
| Carbon Dioxide | 5000 cc/100 in$^2$/24 hr/atm |

-continued

| Property | Value |
|---|---|
| Water Absorption | .0003 lb/ft$^2$ area |
| Dimensional Stability | MD −3%<br>TD +3% |
| Melt Point | 320° F. (160° C.) |
| Dielectric Constant | 1.02 (at 1.0 Kc) |

The flashing device 10 has a water-diverting surface 18 and an engagement surface 20. At least a portion of the engagement surface 20 engages the building exterior and secures the flashing device to the building exterior surface. The water-diverting surface is opposite the engagement surface and cooperates with the siding configuration to direct water away from the building wall surfaces and to the exterior of the siding. FIG. 1 illustrates one embodiment of a flashing device according to the present invention. In this embodiment the engagement surface includes strips 22 of pressure sensitive adhesive sealant material that are applied adjacent to the edges 24 of the notch 12 and to the sides 14 on both sides of the notch.

The preferred adhesive will be one that is strong enough to form a secure bond between the flashing device and the building exterior wall material. If the flashing device is made from a closed cell polypropylene foam like the MICROFOAM® sheet material described above, pressure sensitive adhesives such as the Polybond series of water based vinyl emulsions supplied by Polymer Industries, Polybond BW-23-R4, a solvent based rubber cement, also supplied by Polymer Industries, and E-580, a water based acrylic emulsion from Rohm & Haas, all of which have been used to bond MICROFOAM® to a variety of paper products and films, might be suitable. The type of building material covering the exterior of the building where the flashing device is to be used, as well as the material forming the flashing device, will determine the type of adhesive that will provide optimal performance in securing the engagement surface of the flashing device to the building exterior.

Complementary protective strips of a release material (not shown) are provided to cover the adhesive strips 22 to ensure that the adhesive retains maximum bonding strength until the flashing device engagement surface 20 is applied to engage the exterior building wall surface. Sides 16 of the flashing device 10 are left free and unsecured to the building exterior wall surface.

FIG. 2 illustrates another embodiment of the flashing device 30 of the present invention. In this embodiment the notch 32 is positioned so that the flashing device will fit around the bottom right corner of a window, door or similar structure. Sides 34 adjacent to the notch are shorter than sides 36. The entire engagement surface 38 is completely covered with a layer of a suitable pressure sensitive adhesive. The adhesive layer is then completely covered with a release paper (not shown separately). Removal of the release paper is facilitated by scoring the release paper so that it can be grasped by the installer and removed. If too large a section of release paper is removed, an unwieldy area of sticky flashing material is left uncovered to stick to whatever might get in the way, from tools to siding. If too small an area of release paper is removed, there may not be enough adhesive exposed on the engagement surface to secure the flashing to the building exterior wall. In addition, because the flashing device must be trimmed to fit properly over the siding once it has been positioned, it is undesirable for the section to be trimmed to be sticky.

Another factor to be considered in determining how the release paper should be scored is the use of the flashing device for both right and left window corners. The score lines in FIG. 2 are positioned to permit release paper to be removed only from that portion of the flashing adjacent to the notch so that only the tipper portion of the engagement surface is tacky. This allows the engagement surface in the vicinity of the notch to be positioned on and engage the building exterior while the remainder of the engagement surface will not adhere to anything, which facilitates installation. A pair of intersecting perpendicular score lines 40 and 42 are formed in the release paper. These lines 40 and 42 are preferably formed about one inch below the edges 33 of the notch 32, but also may be positioned elsewhere. This allows the release paper to be removed from substantially the entire area of the engagement surface to be secured to the building exterior wall surface, whether the flashing device 30 is used at the right corner or at the left corner of a door or window. After the flashing device has been trimmed as shown and described in connection with FIG. 3, the remaining strip of release paper can be removed from the engagement surface 38, and pressure can be applied to the flashing device to attach this portion of the engagement surface to the building exterior wall and siding.

Illustrative dimensions for the flashing device 10 found to be suitable for the vast majority of flashing applications are based on a 14 inch square. Sides 14 are then 10 inches in length, and each edge 24 of the notch 12 is 4 inches in length. The sides 16 are 14 inches in length. However, these dimensions are merely illustrative; many other relative dimensions may be selected for the flashing device of the present invention.

Figure 3:
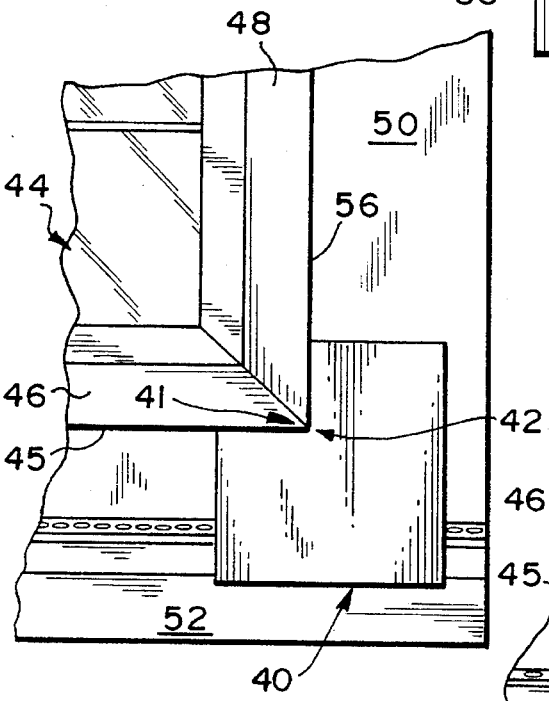
FIG. 3 illustrates the flashing device of the present invention positioned in place at a bottom corner of a window with the engagement surface engaging the building exterior.
Figure 4:
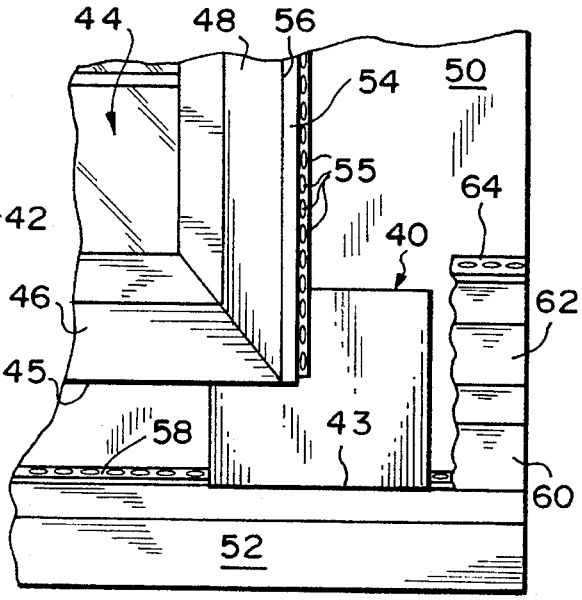
FIG. 4 illustrates the position of the flashing device of the present invention after being trimmed to a suitable length relative to the siding as siding is being installed.
Figure 5:
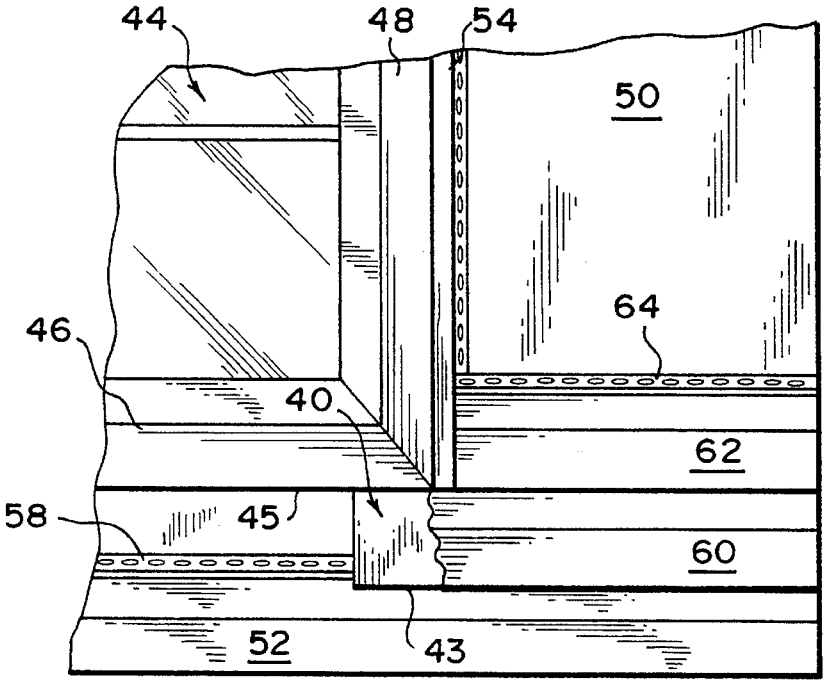
FIG. 5 illustrates the position of the water-diverting surface of the flashing device of the present invention as final siding panels are installed.

FIGS. 3–5 illustrate, in front view, one application of the flashing device of the present invention which produces a water impervious, water-directing barrier at a window joint in conjunction with the installation of vinyl siding. However, the flashing device will also work with aluminum siding, or any other siding material that has a configuration similar to that shown herein. The installation of a flashing device 40 at the bottom right corner 42 of a window 44 is shown in FIGS. 3–5. The window has been trimmed with conventional finish window frame trim pieces 46 and 48. The exterior walls 50 of the building have preferably been prepared with sheathing, housewrap or the like as is customary in the building trade prior to the application of an exterior siding material.

The release paper (not shown) covering the adhesive on the engagement surface of the flashing device 40 is removed to expose the adhesive. The flashing device 40 is then positioned tightly against the window corner 42 so that the corner 42 fits into the notch 41. Pressure on the adhesive will fasten the flashing device 40 to the wall 50 in the correct position. It will be noted that FIG. 3 shows the flashing device 40 extending below the window 44 to partially cover a strip of a siding panel 52 that has been installed under the window.

FIG. 4 illustrates another step in the application of the present flashing device 10. A siding positioning channel 54, which is known in the building industry as a "J" channel, is secured to the wall 50 immediately adjacent to the edge 56 of the vertical window frame trim 48. This positioning channel 54 receives and covers the ends of the siding strips that form a butt joint with the vertical window trim 48. The top of each siding strip, such as panel 52, also includes a similar "J"-type or locking channel 58 along the siding panel upper edge. The cross-sectional configuration of the channel 58 is shown and discussed in connection with FIG. 6.

The siding positioning channel 54 is installed on top of the flashing device 40. Holes 55 are provided in the channel 54 for the nails or other fasteners used to attach the channel 54 and the flashing device 40 to the building wall 50. The flashing device 40 is then trimmed along its lowermost edge 43 so that it just covers the channel 58 of the siding panel 52. It is preferred to trim the flashing device with a tool that will not damage the siding. It has been found that if the material forming the flashing device is too flexible, it cannot be easily trimmed. If the FIG. 2 flashing device embodiment has been installed, the remainder of the release paper will then be removed from the engagement surface. Two additional siding panels 60 and 62 are shown installed above the siding panel 52. Siding panels 60 and 62 are shown partially cut away to illustrate the position of the flashing device 40 relative to the positioning channel 54 and the siding strips 60 and 62.

FIG. 5 illustrates the position of the flashing device with the siding panel or strip 62 extending to the window trim 48. The edges of the siding strip 62 and its locking channel 64 which form a joint with the window trim 48 are covered by the positioning channel 54 to produce a neater, more finished appearance. Siding panel 60 will have to be notched to fit against the lower edge 45 of the horizontal window trim 46. This siding panel 60 is shown cut away to illustrate the flashing device 40. The bottom edge 43 of the flashing device 40 will be enclosed within the siding panel 60 as will be explained in detail in connection with FIG. 6.

Figure 6:
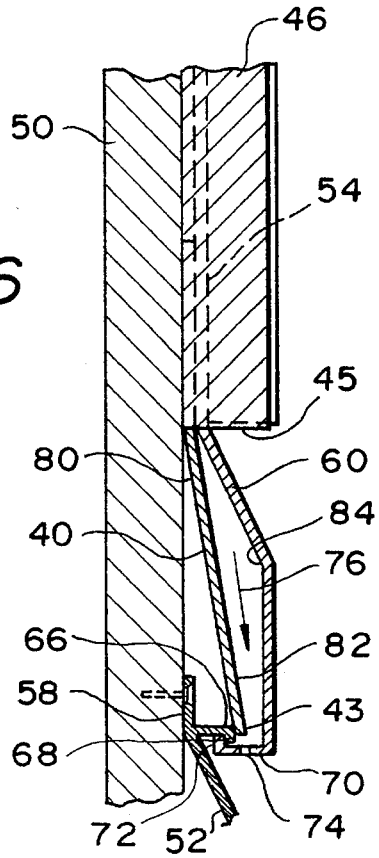
FIG. 6 illustrates the flashing device of the present invention in cross-sectional view installed under the siding material and adjacent to a window frame.

FIG. 6 is a cross-sectional view of the flashing device 40 installed in place at the bottom right corner of a window. This view illustrates how the flashing device 40 directs water away from the building wall 50 and clearly shows the flashing device engagement surface 80 and the water-diverting surface 82. The flashing device lower edge 43 is positioned so that the engagement surface 80 covers the locking channel 58 of siding panel 52, and the water-diverting surface 82 is toward the inner surface 84 of the siding piece 60. The locking channel 58 includes a shoulder 66 which extends substantially perpendicularly outwardly from the wall 50. A depending lip 68 is provided on the shoulder 66 to engage the bottom of the adjacent siding panel 60. The bottom edge of the siding panel 60 includes an extension 70 with a ridge 72 that extends toward the surface of the wall 50 to engage the lip 68 of the locking channel 58 of siding panel 52. The bottom of each successively applied siding panel is similarly configured to engage the locking channel on the top of the siding panel below it. Weep slots or holes 74 are provided as drains at intervals in the extension 70 to allow any moisture that might collect behind the siding to escape. The flashing device 40 is spaced outwardly from the wall surface by the shoulder 66. This causes any water that has collected behind the siding at the corner of the window to be directed along the path shown by arrow 76 so that the water will drain through the weep slot 74. Water will therefore be diverted away from the corner of the window and from the building exterior wall.

Although the flashing device of the present invention has been described with respect to a preferred embodiment for purposes of illustration, it is intended to encompass all structures, arrangements and methods which fall fairly within the scope of the appended claims.

INDUSTRIAL APPLICABILITY

The flashing device of the present invention will find its primary application in creating a moisture impervious, water-diverting barrier adjacent to the corner of a window or door of a building to be covered with an exterior siding material of the vinyl or aluminum type configured to simulate wood clapboard siding.

I claim:

1. A preformed, ready made corner flashing means for creating a moisture-impervious water-directing barrier at either a right or a left corner of a frame of a door or a window located on an exterior wall of a building in cooperation with an exterior wall siding material consisting of a plurality of individual longitudinal panels having a horizontal orientation, wherein a top of each panel includes locking means configured to engage a correspondingly configured engagement means on a bottom of an adjacent overlapping panel for securing the siding panels together, said flashing means comprises a substantially rectangular flat planar structure formed of a flexible, waterproof sheet material selected from the group consisting of foam, vinyl, plastic and coated paper, said flashing means having one corner removed to form a right angle notch configured to fit securely and tightly against any corner of the frame with and under the siding panels so that a minor portion of a wall engaging bottom surface of the flashing means directly contacts and is adhesively secured to the wall adjacent to the frame and a major portion of the wall engaging surface of the flashing means is held away from contact with the wall and in contact with the locking means of one siding panel in an orientation that causes water to be directed along a top water diverting surface of the flashing means and through drain holes in the engagement means of an adjacent siding panel.

2. The flashing means described in claim 1, wherein said flexible, waterproof material is a closed cell foam sheet material.

3. The flashing means described in claim 1, wherein said flexible, waterproof material is a vinyl sheet material.

4. The flashing means described in claim 1, wherein selected areas of a pressure sensitive adhesive covered by a removable release paper are located on the minor portion of the wall engaging surface adjacent to the right angle notch to optimally position and temporarily secure the flashing means to the wall adjacent to a right frame corner or a left frame corner.

5. The flashing means described in claim 1, wherein the wall engaging surface is completely covered with a layer of a pressure sensitive adhesive and said adhesive layer is covered by a layer of a removable release paper, wherein said release paper layer includes a pattern of score lines positioned to permit the selective removal of the release paper from the minor portion or from the major portion.

6. A preformed, ready made universal corner flashing device configured for installation on an exterior wall of a building to create a moisture-impervious, water-directing barrier at a right or left bottom corner of a window located in the exterior wall, wherein said barrier is formed between said exterior wall and longitudinal, horizontal strips of an exterior siding material covering said exterior wall, each of said siding strips including a locking means configured to engage a correspondingly configured engagement means on the bottom of an adjacent overlapping panel, said flashing device comprising a substantially rectangular planar structure formed of a flexible closed cell foam or a vinyl sheet material with a right angle notch located in one corner and sized to fit tightly adjacent to a right or a left corner, a wall engaging lower surface and an opposed water-diverting upper surface, wherein areas of pressure sensitive adhesive covered by a removable release paper are located at least along edges of the notch and edges of the rectangular flashing device contiguous with the notch edges on said wall engaging surface to temporarily secure said flashing device in place on said exterior wall, said areas of pressure sensitive adhesive being located on the flashing device adjacent to the right or the left corner to secure the flashing device while said siding is installed so that said water-diverting surface is positioned relative to the strips of siding adjacent to a window to contact the locking means of a siding strip to direct water away from said exterior wall through drains in said siding strips to the exterior of said siding.

7. The flashing means described in claim 6, wherein a layer of said pressure sensitive adhesive completely covers said wall engaging surface and said release paper is scored in a pattern that permits an easy removal of the release paper only in the area adjacent to the notch when said flashing means is secured to a right or the left bottom corner.

* * * * *